United States Patent [19]

Hergert

[11] 4,133,715

[45] Jan. 9, 1979

[54] HEADBOX AND HOLDERS FOR FLOATING SLICE CHAMBER DIVIDERS

[75] Inventor: Richard E. Hergert, Rockton, Ill.

[73] Assignee: Beloit Corporation, Beloit, Wis.

[21] Appl. No.: 782,498

[22] Filed: Mar. 29, 1977

[51] Int. Cl.[2] ..... D21F 1/02

[52] U.S. Cl. ..... 162/341; 162/343

[58] Field of Search ..... 162/343, 344, 347, 341, 162/336, 216

[56] References Cited

U.S. PATENT DOCUMENTS

| | | | |
|---|---|---|---|
| Re. 28,269 | 12/1974 | Hill et al. | 162/343 |
| 3,843,470 | 10/1974 | Betley et al. | 162/343 |
| 3,853,697 | 12/1974 | Parker et al. | 162/343 |
| 3,888,729 | 6/1975 | Parker et al. | 162/343 |
| 3,923,593 | 12/1975 | Verseput | 162/343 X |

*Primary Examiner*—Richard V. Fisher

*Attorney, Agent, or Firm*—Hill, Gross, Simpson, Van Santen, Steadman, Chiara & Simpson

[57] ABSTRACT

Holders for floating slice chamber dividers are provided with flexible bodies whereby the dividers are relieved from bending strains in their upstream attached end portions. Advantageously these holder facilitate orientation of the slice chambers of headboxes in a manner to provide for unusual compactness in headbox construction and space requirements. Purging of air from the stock flow is facilitated.

23 Claims, 5 Drawing Figures

HEADBOX AND HOLDERS FOR FLOATING SLICE CHAMBER DIVIDERS

This invention relates to improvements in headbox structures and holders for floating slice chamber dividers.

Achievement of uniformity in the formation of paper webs, especially in the Fourdrinier papermaking process, has always required much attention because the stock fibers have a natural tendency to flocculate prematurely before delivery to the web forming surface. An important advance in the art in this regard is described in U.S. Patent Re. No. 28,269, which, to any extent necessary is incorporated herein by reference. According to that patent, certain problems inherent in supplying stock to the forming surface in a Fourdrinier papermaking machine are alleviated by equipping the slice chamber of the headbox with multiple divider elements having their upstream ends attached to a perforated plate at the downstream end of a preslice flow chamber to which stock is delivered from a source through a tube bank and then passes through the perforated plate into the slice chamber. The divider elements extend in substantially free floating relation within the slice chamber and divide the slice chamber into stock channels leading from the plate openings toward the slice opening at the downstream end of the slice chamber. As a result, maximum dispersion of fibers in the papermaking stock is assured in travel through the slice chamber with a minimum of turbulence in the discharge jet from the slice. The divider elements are plates of substantial stiffness at their upstream attached ends and progressively thinner and more flexible toward their downstream ends to achieve a generally self-aligning floating relationship.

The desirability of greater flexibility in the slice chamber divider has been recognized as exemplified, for example, in U.S. Pat. No. 3,843,470 which discloses attachment of the upstream ends of the flexible divider sheets to the perforated headbox plate by means of substantially rigid anchoring devices. A problem with such attachment of the divider sheets is that flexure fatigue has been experienced in the sheets at their attachment ends. Due to shut-down and start-up conditions, there is a high stress level and substantial bending of the sheets at the attachment point so that eventually the sheets crack and split and break off.

Another problem that has been encountered in the use of multiple slice chamber dividers is that although air in the stock is reasonably well purged where the headbox slice is oriented in a generally upward direction toward the travelling forming surface, air bubbles present in the headbox are not readily purged and may build up to the detriment of web formation where for any reason it is necessary or desirable to point the headbox slice generally downwardly, or the machine speed is relatively slow. Small air bubbles will not hurt web formation, but large bubbles disrupt web formation when they exit. In addition large air bubbles tend to accumulate slime. Where the tapered slice nozzle extends in a generally upward direction air bubbles are purged from the system while they are small. However, for secondary headboxes and in some situations where machine space is too cramped or limited to accept the usual upwardly directed slice nozzle, a generally downward orientation of the slice nozzle is desirable. One example of an arrangement to overcome the problem of air accumulation where a downward slice nozzle is warranted, is depicted in U.S. Pat. No. 3,853,697. According to that disclosure, the slice chamber is shaped to have a first upwardly inclined portion supplied from the headbox chamber through the perforated partition plate, and then a second arcuate portion forms a transition with a third downwardly sloping tapered portion leading to the slice opening. However such arrangement requires that the dividers attached to the perforated partition plate conform to the general configuration of the slice chamber. Because of the necessity to conform to the curved transition area within the slice chamber, the dividers must throughout at least a major length of the upwardly directed portion of the slice chamber be substantially rigid with a possibly less rigid curve transition portion, and then only those portions of the dividers downstream from the curved transition are flexible. Thereby at least some control of turbulence is lost and there is a greater tendency of the stock to flocculate before it is introduced onto the forming surface. If the flexible trailing dividers extend too near the slice lip, they must curve toward the slice opening and this introduces an undesirable reduction in turbulence control. If the overall length of the slice nozzle is increased, in order to attain sufficient effective length of the flexible portions of the dividers, a space problem is injected and which this overhead type of headbox is intended to alleviate, but with the disadvantage just discussed.

An important object of the present invention is to overcome the foregoing and other problems and to provide a new and improved headbox structure and holders for floating slice chamber dividers.

Another object of the invention is to provide a new and improved floating slice chamber divider holder which will relieve the attached divider from flexure fatigue damage.

A further object of the invention is to provide a new and improved relationship of paper machine headbox stock supply means and slice chamber with efficient turbulence control and air purging capability.

Still another object of the invention is to improve the compactness and efficiency of paper machine headboxes.

According to features of the invention there is provided for use in combination in a headbox structure for delivering papermaking stock to a forming surface of a papermaking machine wherein a slice chamber has a receiving end across which extends a perforated separating plate through which stock is delivered into the slice chamber for movement through the slice chamber to a slice opening from which the stock is delivered to a papermaking machine forming surface, a holder bar adapted to anchor a channel dividing sheet element to the plate to extend in substantially free floating relation downstream within the slice chamber toward the slice opening, the holder bar having a flexible body portion provided with base means along one edge of the body portion for anchored attachment to the separating plate and means along the opposite edge of the body portion for holding attachment to the upstream end of the sheet element, the body portion being adapted to flex and relieve the attached end portion of the divider sheet element from flexure fatigue.

According to other features of the invention there is provided in a headbox structure means defining a slice chamber having a stock receiving end and an opposite end terminating in a slice opening for delivering stock to a papermaking machine forming surface, means within the headbox for delivering papermaking stock to the receiving end of the slice chamber, a plate separating the stock supply means and the receiving end of the slice chamber, and having openings therethrough for delivering of stock to the slice chamber, divider sheet elements in substantially free floating relation within the slice chamber and dividing the slice chamber into stock channels leading from said plate openings toward the slice opening, and holder bars having flexible body portions provided with means along one of their edges attached to the upstream ends of the sheet elements and having anchoring base means along opposite edges attached to the plate, the body portions being adapted to flex and relieve the attached end portions of the divider elements from bending fatigue stresses.

According to further features of the invention there is provided in a headbox structure for delivering papermaking stock to a forming surface of a papermaking machine means defining a slice chamber comprising floor and roof walls converging to a slice opening and pondsides closing up the sides, a perforated stock inlet plate extending angularly across the opposite end of said slice chamber for delivery of papermaking stock through the perforations in the plate into the slice chamber, divider sheet elements extending across the slice chamber from side-to-side between the pondsides and dividing the slice chamber into a plurality of stock channels, holders anchoring upstream ends of the sheet elements to the plate but leaving the sheet elements otherwise free to float in the slice chamber, the holders being located in such positions on the plate that respective perforations in the plate are in stock supplying alignment with the channels, and the holders being of angular cross section with one angular portion attached to said plate and another angular portion attached to respective upstream ends of the sheet elements, whereby the sheet elements are adapted to extend substantially straight longitudinally within the slice chamber from the holders to adjacent said slice opening and said sheet elements are relieved from liability of bending fatigue.

According to yet another feature of the invention there is provided in a papermaking machine headbox spaced perforated plates having a bank of stock tubes connected to and between the plates and aligned with openings in the plates, one of the plates being located in the headbox to receive papermaking stock under pressure therethrough into the tubes, the second of the plates being downstream from said one plate and with the stock discharging ends of the tubes aligned with perforations through the second plate, means defining a slice chamber extending from the second plate and having walls converging toward a slice opening and with the sides of the slice opening closed by pondsides, a plurality of divider sheet elements extending longitudinally within the slice chamber from adjacent to the second plate and dividing the slice chamber into a plurality of channels communicating at upstream ends with the discharge ends of the tubes and at downstream ends with the slice opening, and anchoring members attached to the second plate and secured in anchoring relation to the upstream ends of the sheet elements permitting the sheet elements to float within the slice chamber.

Other objects, features, and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
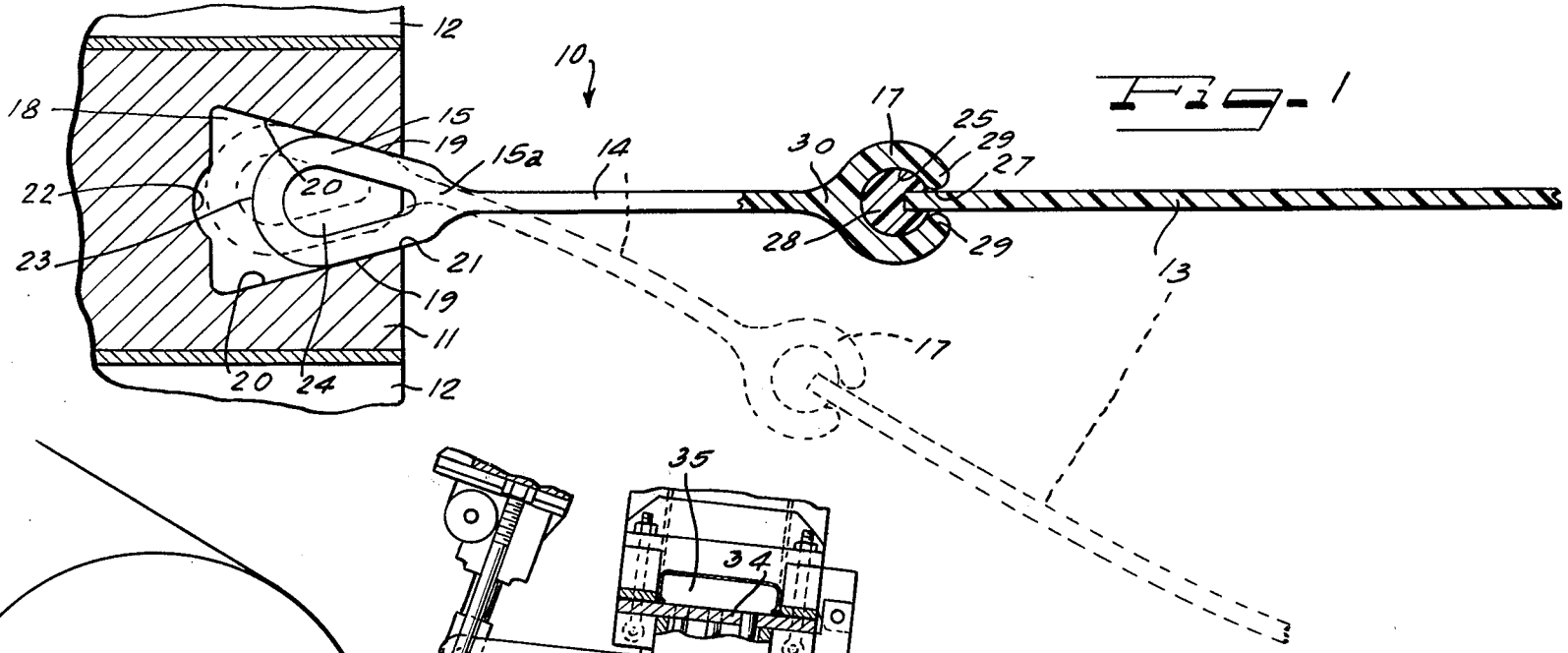
FIG. 1 is a fragmentary sectional detail view showing a form of the new and improved holder bars according to the present invention.

On reference to FIG. 1, a representative divider sheet connector or holder bar 10 is depicted which is adapted to be anchored to a perforated headbox plate 11, for delivering papermaking stock to a forming surface of a papermaking machine. The plate 11 extends across the upstream end of a slice chamber to which the papermaking stock is supplied by way of suitable diameter ports 12 through the plate 11 into the slice chamber for delivery to a papermaking machine from a slice opening at the opposite end of the slice chamber. The holder bar 10 is constructed and arranged to anchor a channel dividing sheet element 13 to the plate 11. In length the holder bar 10 extends substantially from side-to-side of the plate 11, and the sheet element 13 is of a width to extend between the opposite pondsides of the slice chamber and of a length to extend in substantially free floating relation within the slice chamber downstream toward the slice opening.

The divider sheet element 13 may be made from any suitable flexible sheet material. In a typical example, a plastic sheet material such as polycarbonate sheet of about 0.040 inch (1mm) thickness may be used. In any event, the material selected for the divider sheet element 13 should be compatible in material, thickness or gauge, and the like, with the type of papermaking stock to be handled, the stock temperatures involved, stock velocities, and any other factors that may have a bearing upon performance requirement for the divider sheet element.

It will be appreciated, of course, that the stock flow channels into which the slice box is divided by the sheet element 13 must be supplied with paper stock through separate ones of the supply ports 12, certain of which are located to supply stock into the slice box channel above the divider and others to supply stock into the channel below the divider. Before start-up, the divider sheet element 13 tends to hang limply downwardly other limp sheets above it may also press down on it. This means that if the sheet 13 were attached directly to the plate 11 or to a rigid anchoring device, the sheet would necessarily bend possibly fairly sharply at the juncture. During operation any disturbances which may cause the sheet to fluctuate up and down may cause bending at the juncture. In the course of shut-down the weight of stock above the sheet would tend to cause virtually creasing bending at the juncture.

Herein, flexure fatigue is substantially relieved by the novel construction and function of the holder bar 10 which has a resiliently flexible body 14 of substantial length and of generally panel form having integrally therewith along one edge base means 15 for anchored attachment to the plate 11. At its opposite edge, the body 14 has means 17 for holding attachment to the upstream end of the sheet element 13. The body 14 may be about the same thickness as the thickness of the sheet element 13 and of adequate width to be, in effect, an extension of the upstream end of the sheet element 13 contiguous to the face of the plate 11 so that bending movements which would otherwise be in the sheet element 13 are effected in the holder body 14 which is resiliently flexible substantially throughout its length and highly resistant to flexure fatigue. To this end, the holder 10 is desirably formed from plastic material characterized by providing high resistance to bending or flexure fatigue in a resiliently flexible section. In a typical construction, the body 14 may be about ¾ inch (2cm) in width, where the overall width of the bar 10 is about 1½ inches (4.2cm). It will be understood, of course, that the dimensions given are merely representative and may vary depending upon dimensional and operating requirements in any given headbox installation.

To facilitate assembly of the holder bar 10 with the plate 11 the base means 15 comprise an enlargement on and along the body 14 enabling anchoring of the base enlargement in a complementary groove 18 in the face of the headbox plate 11. Assembly of the base enlargement 15 within the groove 18 is adapted to be effected by sliding the base enlargement into the groove from one end of the groove. In a desirable form, the base enlargement 15 is generally pear shape in cross section having opposite substantially straight surfaces 19 which converge generally toward a juncture neck 15*a* with the body 14. Through this arrangement, firm retention of the base enlargement 15 within the groove 18 is affected by engagement of the convergently tapering sides 19 with complementary convergently tapering sidewalls 20 defining the groove and terminating at the face of the plate 11 at a slot opening 21 which permits the neck area of the base enlargement 15 to project from the slot but affords thorough anchoring engagement of the base enlargement 15 with the groove walls 20. Not only to facilitate assembly of the base enlargement 15 in the groove 18, but to permit some relief movement of the base portion in the groove, the groove is deeper than the width of the base enlargement 15 whereby in the relaxed, non-tensioned condition of the holder bar 10, the base enlargement 15 is adapted to be received into the wider root area of the groove and is adapted to tilt, substantially as shown in dash outline in FIG. 1, whereby to minimize bending strain on the body 14 which may, as also shown in dash outline be tilted and bent downwardly with the weight of the sheet element 13. Such tilting of the base enlargement 15 is facilitated by a recess 22 extending longitudinally along the center of the bottom or root surface of the groove 18 and providing a clearance for a rounded inner edge 23 on the anchoring base enlargement 15. To minimize material in the base enlargement 15 and to provide it with some resilient yieldability, it is provided with a hollow interior 24. The wall thickness of the base enlargement 15, however, is desirably greater than the section thickness of the body 14 so that any tendency for the anchoring mass 15 to pull out of the groove 18 is thoroughly resisted.

Construction of the attachment means 17 of the holder bar 10 is in a manner to permit ready assembly of the sheet element 13 with the holder bar. For this purpose, the portion 17 comprises an integral enlargement extending along the edge of the body 14 and provided with a groove 25 extending throughout the length of the enlargement and opening through a narrow slot 27 aligned with the plane of the body 14. In a preferred construction, the groove 25 is of substantially cylindrical form to receive slidably therein a rod-like anchoring element 28 to which the edge of the sheet element 13 is permanently secured. In a preferred construction the anchoring rod 28 may be made of the same material as the sheet element 13. In the assembly, the anchored end portion of the sheet element 13 extends through the slot 27 between rounded lips 29 which serve to retain the anchor rod 28 and may permit a limited relative rocking adjustment of the anchoring rod in the groove 25. Mass of the retaining enlargement 17 including a tapered neck juncture 30 with the body portion 14 is desirably no greater than the mass of the base enlargement 15 in order to minimize residual extrusion stresses. For excellent retention capability and to resist thoroughly any tendency for the lips 29 to spread under operating tension of the sheet element 13 imposed thereon, the section modulus of the walls of the enlargement 17 including the lips 29 is greater than the section modulus of the body 14. It may be noted that the knuckle provided by the enlargement 17 by virtue of its location downstream relative to the stock supply ports 12 will serve to effect a more rapid evening or smoothing out of the jet streams issuing from the port than if the sheet element 13 were to extend directly from the face of the headbox plate 11. Thereby the knuckle enlargement 17 cooperates with the sheet element 13 in diminishing turbulence in the slice chamber channels while nevertheless maintaining a high degree of fiber dispersion.

Figure 2:
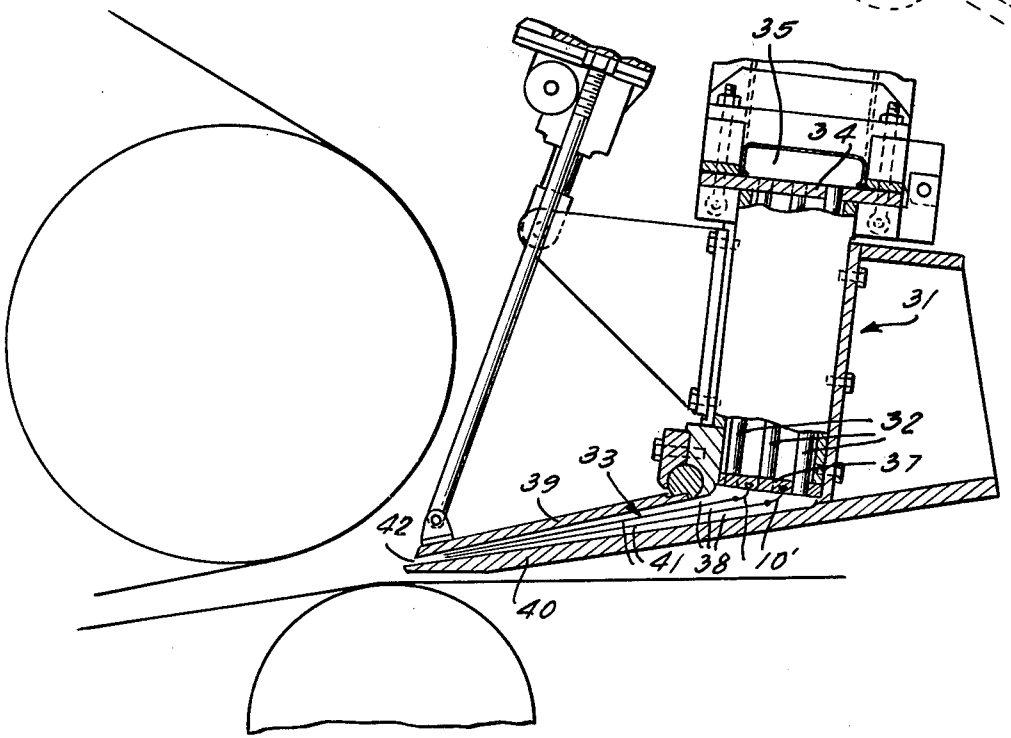
FIG. 2 is a vertical schematic fragmentary sectional detail view showing one form of headbox structure embodying features of the invention installed in a two wire papermaking machine.

Although as shown in FIG. 1 the holder bar 10 is adapted to extend generally normal to the face of the headbox plate 11 in line with the sheet element 13, by virtue of the spaced relation between the anchoring enlargement 15 and the knuckle enlargement 17 provided by the body 14, an angular orientation of slice chamber divider sheets relative to the headbox plate is feasible by shaping the holder bars 10' of angular cross section as depicted in FIG. 2, by way of example in a headbox 31 which is especially adapted to serve as a secondary headbox for a twin wire former. Aside from the fact that the body portions of the holder bars 10' are bent curvately on generally longitudinal median lines, substantially as shown, the holder bars are of the same construction and function substantially the same as described for the holder bar 10 in FIG. 1.

Because of the excellent turbulence control afforded by use of the angular cross section holder bars 10', there is no need for a preslice flow chamber between a stock tube bank 32 and a slice chamber 33. The stock tubes of the stock tube bank 32 are connected at their upstream ends to a perforated headbox plate 34 to receive stock from a stock inlet 35. At their downstream ends the tubes of the bank 32 discharge through a headbox plate 37 into slice chamber channels 38 defined between top and bottom generally convergently related slice box walls 39 and 40 and a plurality of flexible divider sheet elements 41 anchored to the headbox plate 37 by means of the holder bars 10'. As will be observed, the described arrangement permits the axis of the slice chamber 33 to be disposed at an acute angle to the axis of the stock tube bank housing portion of the headbox structure and wherein the plate 37 extends angularly across the upstream end of the slice box. Each of the divider sheet elements 41 is of a width to extend entirely across the slice chamber 33 with the opposite edges of the sheet elements close to the opposite side walls or pond-sides of the slice chamber nozzle structure. By reason of their angular disposition relative to the stock supply plate 37, the upstream ends of the sheet elements 41 may be fairly closely spaced so that the channels 38 may be quite thin for maximum efficiency in fine dispersion of the stock flowing therethrough to a slice opening 42 at the discharge end of the slice chamber. To compensate for the angular dispostion of the plate 37 to which they are anchored, the sheet elements 41 are desirably of a differential length sufficient to attain substantially coextensive termination adjacent to the slice opening 42.

Figure 3:
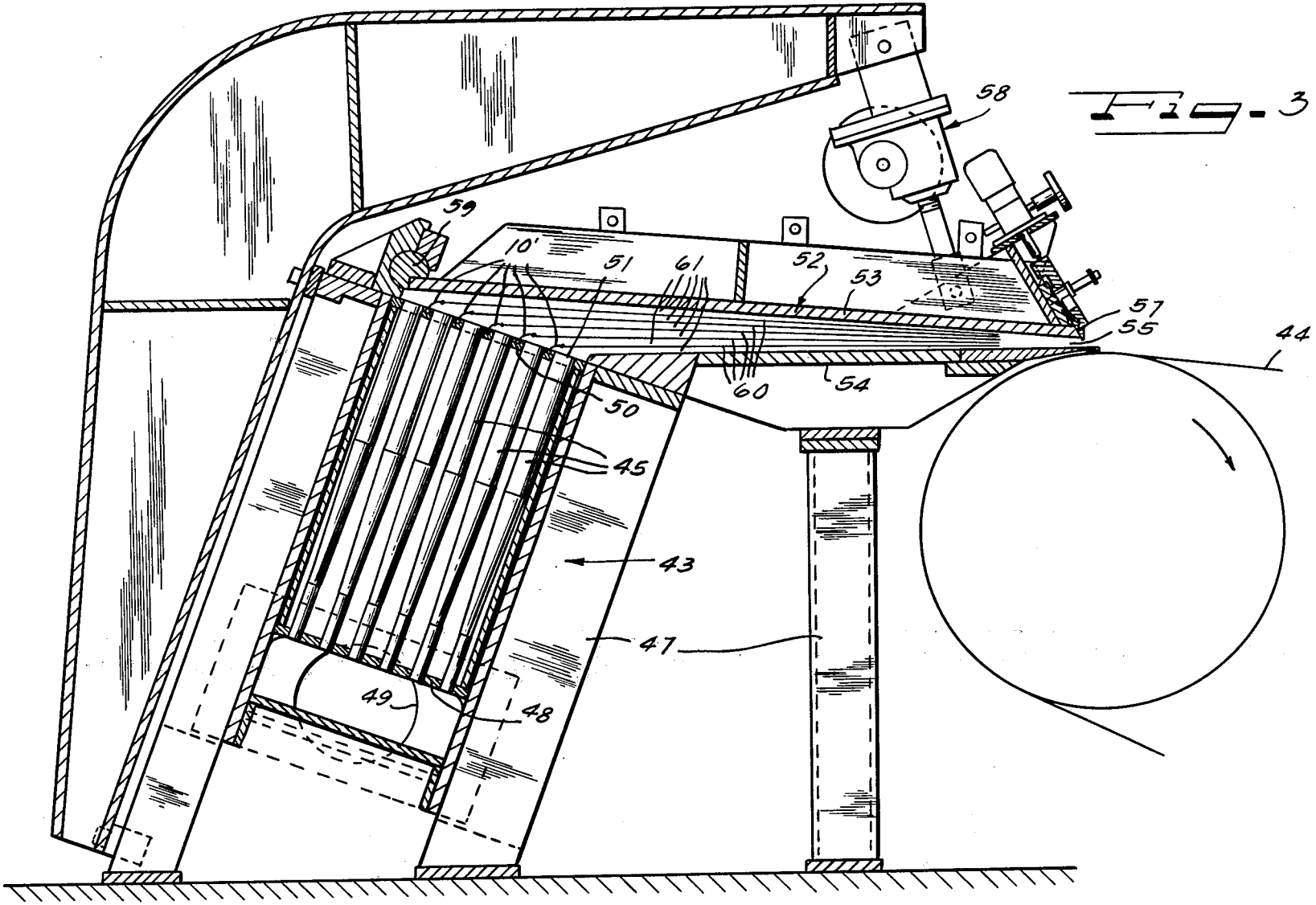
FIG. 3 is a vertical sectional detail view showing a headbox structure embodying features of the invention and adapted for supplying paper stock to a Fourdrinier papermaking machine.

Instead of the overhead arrangement for secondary headbox as in FIG. 2, a compact primary headbox 43 (FIG. 3) of advantageous compact arrangement and equipped with the angular cross section holder bars 10' is adapted to deliver stock to a Fourdrinier papermaking machine wire 44. In this arrangement, the generally upright lower supply portion of the headbox 43 having a bank of stock tubes 45 is directed generally upwardly and supported by machine frame 47. At their upstream, lower ends the stock tubes 45 receive stock supply through a perforated supporting plate 48 from a stock inlet 49. At their downstream, upper ends the stock tubes 45 are connected to a perforated supporting plate 50 having ports 51 which deliver stock to the upstream end of a slice chamber 52 which has its axis extending at an acute angle from the plane of the plate 50 and relative to the axis of the tube bank. Top and bottom walls 53 and 54, respectively, defining the slice chamber 52 converge toward a slice opening 55 having an adjustable lip 57 for effecting fine adjustments in the width of the slice opening, while the top wall 53 is adjustable by means of an adjustment jack 58 about a rear end pivot 59 to effect major slice opening adjustments. Within the slice chamber 52 divider sheet elements 60 anchored at their upstream ends to the holder bars 10' divide the slice chamber 52 into stock turbulence controlling channels 61. As will be observed the sheet elements 60 are of graduated length to compensate for the angular disposition of the plate 50 to which they are anchored and so that the downstream ends of the sheet elements will be substantially coextensive adjacent to the slice opening 55.

Figures 4, 5:
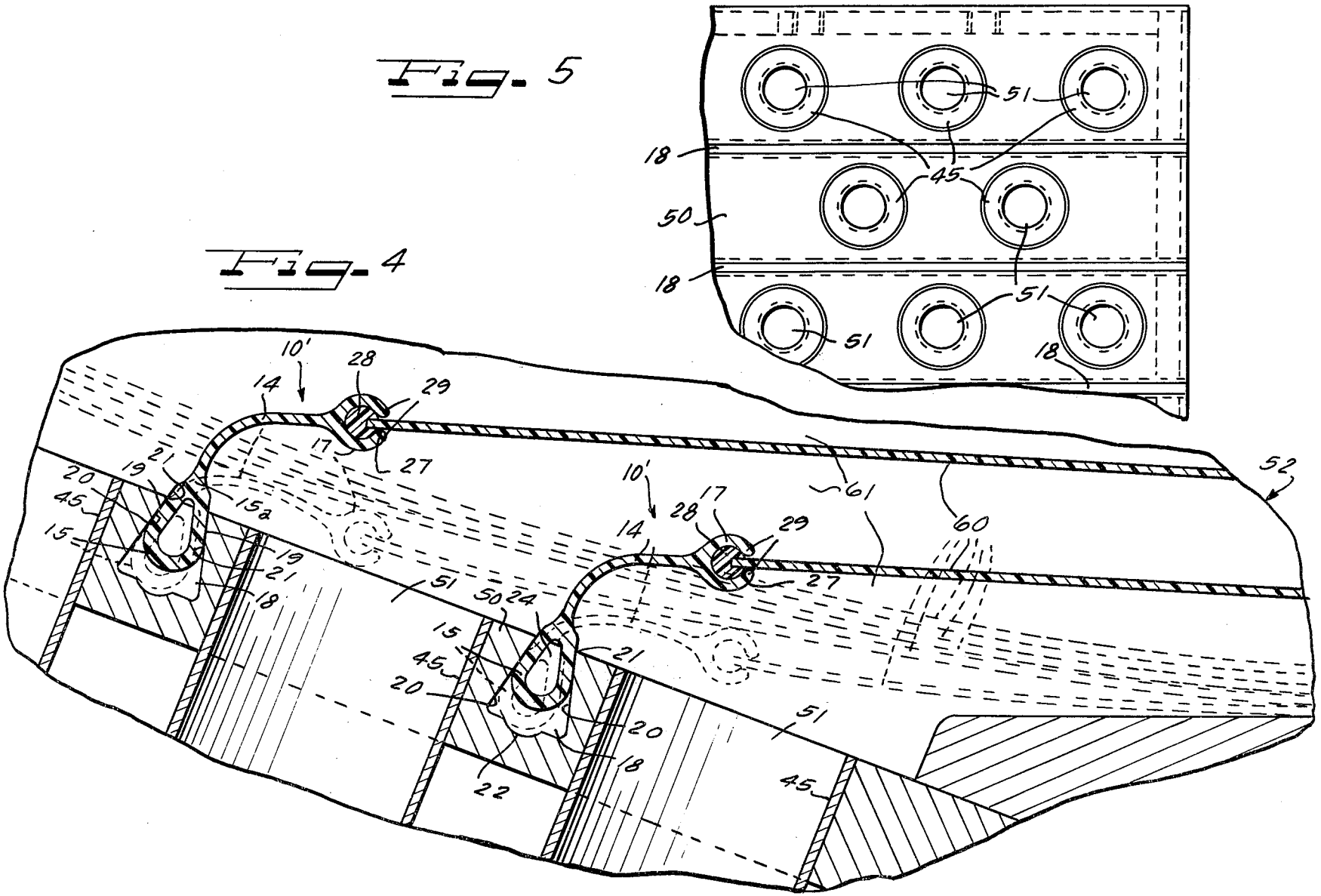
FIG. 4 is an enlarged sectional detail view of a portion of the perforated plate at the upstream end of the slice chamber in the device of FIG. 3.
FIG. 5 is a fragmentary plan view of the plate shown in FIG. 4.

As best demonstrated in FIGS. 4 and 5, the acute angular relationship of the perforated headbox supply plate 50 and the divider sheets 60 as enabled by the anchorage of the sheets by means of the angular cross section holder bars 10' advantageously effects a substantially smaller spacing between the divider sheets and between the top and bottom walls defining the slice chamber and the divider sheets nearest thereto then would be the case if the divider sheets were to extend normal to the plane of the plate 50. For example, where the on-center spacing between the anchoring grooves 18 is on the order of about 2 inches in practice, the acute angularity in the planes of the perforated plate 50 and the divider sheets 60 may be such as to provide an upstream end thickness of the channels 61 between the divider sheets of about ½ inch, that is in a ratio of about 1 to 4. Thereby the speed of the paper stock in the channels travels at greater velocity than in a thicker channel arrangement, and attains improved turbulence control and fine fiber dispersion to the slice opening 55 where the stock is delivered with uniform dispersion to the forming wire 44. At the entrances into the slice chamber channel 61 from the ports 51, the angularly bent holder bars 10' provide efficient stock flow diverting surfaces cooperating with the upstream ends of the anchored divider sheets 60. Because of the excellent turbulence control over the stock supplied by the stock tubes 45, there is no need for a preslice chamber between the stock tube bank and the slice chamber, thereby saving substantial room in the headbox structure, in addition to the more compact arrangement permitted by the angular construction of the headbox as shown.

It will be understood that variations and modifications may be effected without departing from the spirit and scope of the novel concepts of this invention.

I claim as my invention:

1. In a headbox structure for delivering papermaking stock to a forming surface of a papermaking machine wherein a slice chamber has a receiving end across which extends a perforated headbox plate through which stock is supplied into the slice chamber for movement through the slice chamber to a slice opening from which the stock is delivered to a papermaking machine forming surface:

a holder formed from plastic material of high resistance to bending fatigue and anchoring a channel dividing sheet element to said plate to extend in substantially free floating rotation downstream within the slice chamber toward the slice opening;

said holder having a resiliently flexible body of substantial length between opposite end edges;

base means integrally along one edge of said body and in anchored attachment to said plate;

and means integrally along the opposite edge of the holder body and in holding attachment to the upstream end of the sheet element;

said body being of about the same thickness as the thickness of said sheet element and flexible substantially throughout its length between said edges and substantially relieving the attached end portion of the divider sheet element from flexure fatigue.

2. A headbox according to claim 1, said holder being in the form of a bar of a width to extend across substantially the width of the associated slice chamber.

3. A headbox according to claim 1, wherein said holder body is substantially straight between said base means and said holding attachment means.

4. A headbox according to claim 1, wherein said holder body is of angular shape between said base means and said means for holding attachment.

5. A headbox according to claim 1, wherein said base means and said holder body are formed integrally in one piece, and said base means comprise an enlargement relative to said body and having substantially straight sides tapering toward said body portion.

6. In combination in a headbox structure for delivering papermaking stock to a forming surface of a papermaking machine:

means defining a slice chamber having a stock receiving end and an opposite end terminating in a slice opening;

means within the headbox for delivering papermaking stock to said receiving end of the slice chamber;

a plate separating said stock supply means and said receiving end of the slice chamber and having openings therethrough for delivery of stock to the slice chamber;

divider sheet elements in substantially free floating relation within the slice chamber and dividing the slice chamber into stock channels leading from said plate openings toward said slice opening;

and holders formed from plastic material of high resistance to bending fatigue and each having a flexible body of substantial length between opposite end edges and provided integrally with holding attachment means on one end attached to the upstream end of one of the divider sheet elements, and each holder being provided with anchoring base means along an opposite end attached to said plate;

said body being of about the same thickness as the thickness of said sheet elements and being resiliently flexible substantially throughout its length between said ends for relieving the attached end portion of said divider element from bending strains.

7. A combination according to claim 6, wherein said holders are in the form of bars of a width to extend across substantially the width of the slice chamber.

8. A combination according to claim 6, wherein said body of each holder is substantially straight between said holding attachment means and anchoring base means.

9. A combination according to claim 6, wherein said body of each holder is of angular shape between said holding attachment means and anchoring base means.

10. A combination according to claim 6, wherein said holding attachment means comprise an enlarged head on the body of each of said holders provided with a groove substantially parallel to the plane of the divider element, said enlarged heads having respective slots aligned with the divider elements, each of the divider sheet elements having an anchoring enlargement received in the groove of the holder associated with the divider sheet element in each instance, and said heads having lips along the slot openings projecting toward one another for holding the anchoring enlargements of the divider sheet elements against escape from the grooves.

11. A combination according to claim 6, wherein said anchoring base means comprise respective enlargements on the holders, said plate having grooves thereacross between the openings through the plate, said base means enlargements being mounted in said grooves, and said grooves being deeper than said base means enlargements whereby a range of movement into the grooves is permitted for said base means enlargements.

12. In combination in a headbox structure for delivering papermaking stock to a forming surface of a papermaking machine:

means defining a slice chamber comprising floor and roof walls and pondsides, the floor and roof walls being substantially straight throughout their lengths and converging to a slice opening at one end of the slice chamber;

a perforated stock supply plate extending across the opposite end of said slice chamber at a slanting angle between said floor and roof walls for delivery of papermaking stock through ports in the plate into the slice chamber, said angle being such that all of the ports are directed toward one of said walls;

divider sheet elements extending across the slice chamber from side-to-side between the pondsides and dividing the slice chamber into a plurality of stock channels;

holders anchoring upstream ends of said sheet elements to said plate but leaving the sheet elements otherwise free to float in the slice chamber;

said holders being located in such positions on the plate that respective ports in the plate are in stock supplying alignment with said channels;

and the holders having bodies which are of angular cross section lengthwise of the holders with one angular portion attached to said plate and extending generally in the direction in which the plate faces into the slice chamber, and another angular portion attached to the respective upstream ends of the sheet elements and extending generally in the direction of the sheet elements;

whereby the sheet elements are adapted to extend substantially straight longitudinally within the slice chamber from their attachment to the holders to adjacent said slice opening, said holders divert the papermaking stock from said ports into said stock channels, and said sheet elements are relieved from liability of bending fatigue.

13. A combination according to claim 12, wherein said holders are formed from plastic material providing high resistance to bending fatigue and said bodies are of a thickness about the same as the thickness of the divider sheet elements.

14. A combination according to claim 12, wherein said holders are in the form of bars of a thickness about the same as the thickness of said elements but with enlarged attachment means at their opposite ends and of a length to extend across substantially the width of the slice chamber.

15. A combination according to claim 12, wherein said holders have base enlargements on said one angular portions provided with sides tapering toward said bodies, said plate having grooves extending between said stock parts, said grooves having side walls complementary to said base means enlargements sides and engaged by said base means enlargement sides to retain the holders mounted on the plate, and said grooves being deeper than said base enlargements whereby a range of movement into the grooves is permitted for said base means enlargements.

16. A combination according to claim 12, wherein said holders have knuckles on said another angular portions, and said sheet elements have anchoring means on their upstream ends attached to said knuckles and having a limited rocking capability relative to the knuckles.

17. A combination according to claim 16, wherein said knuckles have generally cylindrical grooves opening through narrow slots between retaining lips, and said anchoring means on the sheet elements are rods secured to the sheets and slidably received in said grooves with the sheets projecting through said slots.

18. A combination according to claim 12, wherein said holder bodies are resiliently flexible substantially throughout their lengths between base means on said one angular portions attached to said plate and sheet holding means on said another angular portions attached to said sheet elements.

19. In combination in a papermaking machine headbox:

spaced perforated plates having a bank of stock tubes connected to and between the plates and aligned with openings in the plates, one of said plates being located in the headbox to receive papermaking stock under pressure therethrough into the tubes, the second of the plates being downstream from said one plate and with the stock discharging ends of the tubes attached to, and aligned with ports through, the second plate;

means defining a slice chamber extending from said second plate and having walls converging between pondsides toward a slice opening;

a plurality of divider sheet elements extending longitudinally within said slice chamber from adjacent to said second plate and dividing the slice chamber into a plurality of channels;

holders attached to said second plate and secured in anchoring relation to the upstream ends of said sheet elements permitting the sheet elements to float within the slice chamber;

and said channels communicating at upstream ends with respective ones of said discharge ends of the bank of stock tubes and communicating at downstream ends with said slice opening.

20. A combination according to claim 19, wherein each of said holders has a body which is resiliently flexible substantially throughout its length whereby to relieve the attached sheet element from bending stresses.

21. A combination according to claim 19, wherein said second plate has grooves extending from side-to-side thereacross at spaced intervals with discharge ends of the tubes and ports opening in rows between the grooves, said grooves having opening slots narrower than the grooves, said holders comprising bars having base enlargements retainingly engaged in said grooves by sliding the base enlargements into the grooves from one end of each of the grooves, and said grooves being deeper than said base enlargements whereby a range of movement in the grooves is permitted for said base enlargements.

22. In a headbox structure for delivering papermaking stock to a forming surface of a papermaking machine wherein a slice chamber has a receiving end across which extends a perforated headbox plate through which stock is supplied into the slice chamber for movement through the slice chamber to a slice opening from which the stock is delivered to a papermaking machine forming surface;

a holder formed from plastic material of high resistance to bending fatigue and anchoring a channel dividing sheet element to said plate to extend in substantially free floating relation downstream within the slice chamber toward the slice opening;

said holder having a resiliently flexible body of substantial length between opposite end edges;

base means integrally along one edge of said body and in anchored attachment to said plate;

and means integrally along the opposite edge of the holder body and in holding attachment to the upstream end of the sheet element;

said body flexible subtantially throughout its length between said edges and substantially relieving the attached end portion of the divider sheet element from flexure fatigue;

said means in holding attachment comprising an enlarged head on the body provided with a groove substantially parallel to the plane of the anchored sheet element;

said groove receiving an anchoring enlargement on the sheet element and having lips along the groove opening projecting toward one another to a spaced relation slightly greater than the thickness of the sheet element and holding the sheet element anchoring enlargement against escape from the groove but permitting a limited range of rocking movement of the anchoring enlargement in the groove.

23. In combination in a headbox structure for delivering papermaking stock to a forming surface of a papermaking machine:

means defining a slice chamber having a stock receiving end and an opposite end terminating in a slice opening;

means within the headbox for delivering papermaking stock to said receiving end of the slice chamber;

a plate separating said stock supply means and said receiving end of the slice chamber and having openings therethrough for delivery of stock of the slice chamber;

divider sheet elements in substantially free floating relation within the slice chamber and dividing the slice chamber into stock channels leading from said plate openings toward said slice opening;

and holders formed from plastic material of high resistance to bending fatigue and each having a flexible body of substantial length between opposite end edges and provided integrally with holding attachment means on one end attached to the upstream end of one of the divider sheet elements, and each holder being provided with anchoring base means along an opposite end attached to said plate;

said body being resiliently flexible substantially throughout its length between said ends for relieving the attached end portion of said divider element from bending strains;

said anchoring base means and said body being formed integrally on each of the holders, and said base means comprising on each of the holders an enlargement relative to the body and provided with substantially straight sides tapering toward said body;

said plate having grooves provided with sides complementary to said tapering sides of said base means enlargements, said grooves being of a depth permitting said base means enlargements to move between extended and retracted positions in the grooves.

* * * * *